US010337177B2

(12) United States Patent
Stein

(10) Patent No.: US 10,337,177 B2
(45) Date of Patent: Jul. 2, 2019

(54) SANITARY INSERT UNIT

(71) Applicant: Neoperl GmbH, Mullheim (DE)

(72) Inventor: Alexander Stein, Ihringen (DE)

(73) Assignee: Neoperl GmbH, Müllheim (DE)

( * ) Notice: Subject to any disclaimer, the term of this patent is extended or adjusted under 35 U.S.C. 154(b) by 0 days.

(21) Appl. No.: 14/988,061

(22) Filed: Jan. 5, 2016

(65) Prior Publication Data

US 2016/0222638 A1 Aug. 4, 2016

(30) Foreign Application Priority Data

Feb. 3, 2015 (DE) ..... 20 2015 000 854 U

(51) Int. Cl.
*E03C 1/084* (2006.01)

(52) U.S. Cl.
CPC ..... *E03C 1/084* (2013.01)

(58) Field of Classification Search
CPC ..... E03C 1/08; E03C 2001/082; E03C 1/084; E03C 1/086; G05D 7/012
USPC ..... 239/428.5
See application file for complete search history.

(56) References Cited

U.S. PATENT DOCUMENTS 3,847,178 A 11/1974 Keppel
4,000,857 A * 1/1977 Moen ..... B05B 1/3006 137/860
4,562,960 A * 1/1986 Marty ..... E03C 1/084 138/45
7,594,519 B2 9/2009 Hart et al.
8,925,831 B2 1/2015 Denzler
2003/0141382 A1 7/2003 Grether et al.
2006/0144962 A1* 7/2006 Zoller ..... E03C 1/08 239/428.5
2010/0147397 A1* 6/2010 Zoller ..... G05D 7/012 137/115.13
2010/0163478 A1* 7/2010 Yuan ..... E03C 1/08 210/251

(Continued)

FOREIGN PATENT DOCUMENTS

DE 2131117 1/1973
DE 10027986 12/2001

(Continued)

*Primary Examiner* — Darren W Gorman
(74) *Attorney, Agent, or Firm* — Volpe and Koenig, P.C.

(57) ABSTRACT

A sanitary insert unit having a jet regulator, an attachment screen arranged upstream of the jet regulator, and a throughflow-quantity regulator, provided between the jet regulator and attachment screen, having an elastic flow-restricting body that encloses, between itself and a regulating profiling provided on a circumferential wall, a water pressure changeable control gap. The throughflow-quantity regulator is releasably retained on the jet regulator and the attachment screen is releasably retained on the throughflow-quantity regulator. The regulating profiling is provided on the circumferential wall of a regulating body that is connected to a holder via at least one connecting crosspiece that acts as a holding-down part for the flow-restricting body, which is arranged between the connecting crosspiece and the jet regulator. The holder's inflow-side end periphery region is releasably fastened on the attachment screen and its outflow-side end periphery region is releasably fastened on the inner circumference of the regulator housing.

12 Claims, 1 Drawing Sheet

(56) References Cited

U.S. PATENT DOCUMENTS

| | | | | |
|---|---|---|---|---|
| 2011/0278380 | A1* | 11/2011 | Zoller | E03C 1/08 239/601 |
| 2012/0325928 | A1* | 12/2012 | Gransow | B05B 1/16 239/8 |
| 2013/0082121 | A1* | 4/2013 | Stein | G05D 7/012 239/428.5 |
| 2013/0082122 | A1* | 4/2013 | Stein | E03C 1/084 239/428.5 |

FOREIGN PATENT DOCUMENTS

| | | |
|---|---|---|
| DE | 10312856 | 10/2004 |
| DE | 202005010640 | 1/2006 |
| DE | 202005004195 | 8/2006 |
| DE | 102009057559 | 4/2011 |
| WO | 9516099 | 6/1995 |
| WO | 2005118968 | 12/2005 |

* cited by examiner

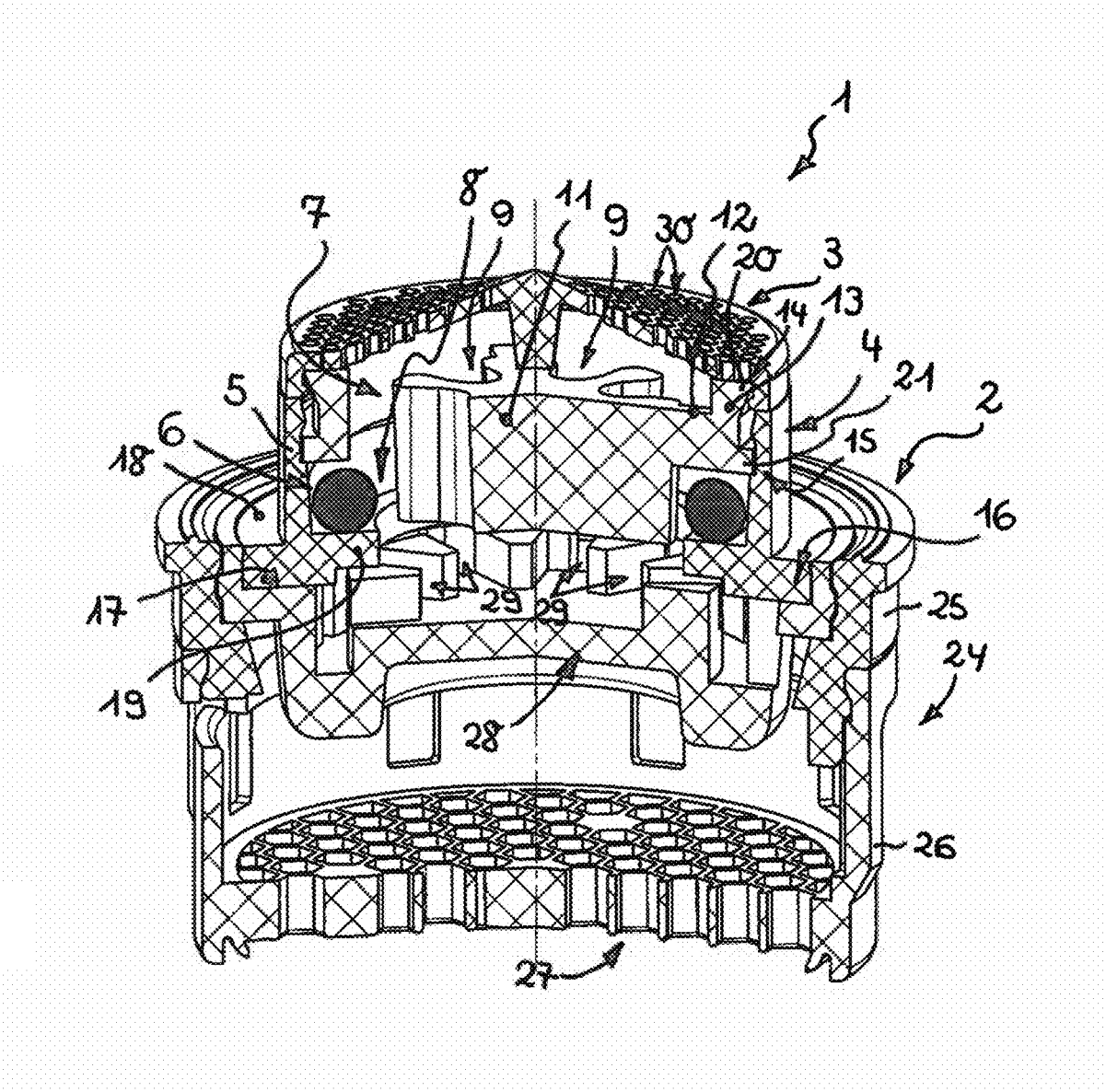
1
7
8
9
11
9
30
12
20
3
14
13
4
21
2
5
6
18
15
16
17
29
29
25
24
19
28
26
27

SANITARY INSERT UNIT

INCORPORATION BY REFERENCE

The following documents are incorporated herein by reference as if fully set forth: German Patent application No. 202015000854.2, filed Feb. 3, 2015.

BACKGROUND

The invention relates to a sanitary insert unit having a jet regulator, having an attachment screen, which is arranged upstream of the jet regulator on the inflow side, and having a throughflow-quantity regulator, which is provided between the jet regulator and attachment screen and has a flow-restricting body which is made of elastic material and encloses, between itself and a regulating profiling provided on a circumferential wall, a control gap which changes under the pressure of the water flowing therethrough, wherein the throughflow-quantity regulator is retained in a releasable manner on the jet regulator and the attachment screen is retained in a releasable manner on the throughflow-quantity regulator.

Applicant's EP 0 733 148 A1 has already disclosed a sanitary insert unit having a jet regulator, having an attachment screen, which is arranged upstream on the inflow side, and having a throughflow-quantity regulator, which is arranged between the jet regulator and attachment screen. While the jet regulator is intended to form a homogenous and non-splashing water jet, the attachment screen is intended to hold back the particles of dirt possibly entrained in the water flowing therethrough. The interposed throughflow-quantity regulator has the task of adjusting, and limiting, to a fixed maximum value, irrespective of the water pressure, the volume of water flowing through per unit of time. For this purpose, the throughflow-quantity regulator has an annular flow-restricting body which is made of elastic material and encloses, between itself and a regulating profiling provided on a circumferential wall, a control gap which changes under the pressure of the water flowing through. The throughflow-quantity regulator, the attachment screen and the jet regulator of the previously known insert unit each have, at their ends which are directed towards one another, matching connectors, which ensure that these installation parts are connected in a releasable manner. This makes it possible for the jet regulator of the previously known insert unit to be used, possibly also at random or accidentally, with the throughflow-quantity regulator alone or with the attachment screen alone. However, if the jet regulator is used with the throughflow-quantity regulator alone, there is, inter alia, a risk of particles of dirt possibly entrained in the water stream passing into the quantity regulator and giving rise there to poor performance, and in particular to a lower output capacity, of the throughflow-quantity regulator. As a result of the installation parts being randomly combined in this way, there is a risk of the previously known insert unit not being able to perform its intended function, or not being able to do so in optimum fashion.

SUMMARY

It is therefore, in particular, an object to provide a sanitary insert unit of the type mentioned in the introduction which, despite being provided in a number of parts, always has its installation parts combined together to ensure optimum functioning of the insert unit according to the invention.

This object is achieved according to the invention, in the case of the sanitary insert unit of the type mentioned in the introduction, in particular in that the regulating profiling is provided on at least one circumferential wall of a regulating body, in that the regulating body is connected to a holder via at least one connecting crosspiece, in that the at least one connecting crosspiece is provided as a holding-down part for the flow-restricting body, which is arranged between the at least one connecting crosspiece and the jet regulator, and in that the holder can have its inflow-side end periphery region fastened in a releasable manner on the attachment screen and its outflow-side end periphery region fastened in a releasable manner on the inner circumference of the regulator housing.

In the case of the insert unit according to the invention, the regulating profiling is provided on an inner and/or outer circumferential wall of a regulating body. This regulating body is connected to a holder via at least one connecting crosspiece, and said holder has its inflow-side end periphery region fastened in a releasable manner on the attachment screen and its outflow-side end periphery region fastened in a releasable manner on the inner circumference of the regulator housing. The at least one connecting crosspiece here, which connects the at least one holder to the regulating body, is designed in the form of a holding-down means, which retains the flow-restricting body in the region between the jet regulator, on the one hand, and the at least one connecting crosspiece, on the other hand. Since the holder connects the attachment screen to the throughflow-quantity regulator, the holder, which is connected to the regulating body, constitutes a kind of tamperproof seal, such that the attachment screen and the jet regulator can be held together only when the throughflow-quantity regulator is also installed. If the throughflow-quantity regulator is forgotten for example when the insert unit according to the invention is being assembled, then it is not possible for the attachment screen to be installed either and the mistake is immediately evident.

In order for it to be possible for the installation parts of the insert unit according to the invention to be connected to one another in a sustainable, and nevertheless immediately releasable manner, and for the installation length of the insert unit according to the invention to be kept as small as possible, it is advantageous if the throughflow-quantity regulator has a regulator housing, which can have its outflow-side end region inserted in an insertion opening on the jet regulator.

The position provided between the installation parts of the insert unit according to the invention is defined precisely if the jet regulator has an annular shoulder, which delimits the insertion path of the regulator housing into the insertion opening.

A preferred development according to the invention provides, on the outer circumference of the regulator housing, an annular flange, by which the regulator housing can be inserted into the insertion opening. In the case of this embodiment, the throughflow-quantity regulator, in comparison with the jet regulator, has an external diameter which is reduced by the amount of the annular flange, and it is therefore also possible for the insert unit according to the invention to be inserted into the possibly small clear throughflow cross section at the outlet end of a sanitary outlet fitting.

On the inflow side of the throughflow-quantity regulator, the flow-restricting body is secured in the axial direction by the at least one connecting crosspiece, which serves as a holding-down part. In order for such an axial securing action also to be ensured on the outflow side, it is advantageous to provide, on the inner circumference of the regulator housing, an annular flange, on which the flow-restricting body rests in the use position. The flow-restricting body thus secured axially on either side is therefore retained in the desired position in the region of the regulating profiling.

A particularly easy-to-produce embodiment according to the invention provides for the at least one holder to be capable of latching in a releasable manner on the attachment screen and/or on the regulator housing.

It is possible for the regulating core to have formed on it a plurality of holders which act on the attachment screen and/or on the regulator housing at a plurality of spaced-apart fastening locations. A preferred embodiment according to the invention, however, is one in which the holder is configured in the form of a retaining ring.

It is advantageous to provide, on the holder, at least one latching protrusion, a latching recess or similar latching part, which latching part interacts with a mating latching part on the attachment screen and/or on the regulator housing.

It is particularly advantageous if the jet regulator has a jet divider, which is of cup-like configuration and, on the circumferential wall of its cup shape, has a plurality of preferably uniformly spaced-apart throughflow openings, by which the water flowing through is divided up into a plurality of individual jets.

BRIEF DESCRIPTION OF THE DRAWINGS

Further features according to the invention can be gathered from the following description of the FIGURES in conjunction with the claims and the drawing. The invention will be described in yet more detail hereinbelow with reference to a preferred exemplary embodiment.

The single FIGURE illustrates a sanitary insert unit in longitudinal section.

DETAILED DESCRIPTION OF THE PREFERRED EMBODIMENTS

The single FIGURE illustrates a sanitary insert unit 1 which, with the aid of an outlet mouthpiece (not shown specifically), can be installed at the outlet end of a sanitary outlet fitting. The insert unit 1 has a jet regulator 2, which is intended to form a homogenous, non-splashing, and possibly also effervescent-soft, water jet. An attachment screen 3 is arranged upstream of the jet regulator 2 on the inflow side and has the task of holding back the particles of dirt which may possibly be entrained in the water, and could impair the function of the downstream functional units. A throughflow-quantity regulator 4 is provided between the jet regulator 2 and the attachment screen 3 and is intended to limit, and adjust, to a fixed maximum value, irrespective of the water pressure, the volume of water flowing through.

The throughflow-quantity regulator 4 has a sleeve-like regulator housing 5, in the interior of which is provided an annular flow-restricting body 6 made of elastic material. The flow-restricting body 6 encloses, between itself and a regulating profiling 7 provided on a circumferential wall, a control gap 8 which changes under the pressure of the water flowing through. The flow-restricting body 6 here, as the water pressure rises, is pressed increasingly into the recesses 9 of the regulating profiling 7, such that the control gap 8 narrows and keeps free a throughflow cross section which decreases in dependence on the water pressure.

The throughflow-quantity regulator 4 is retained in a releasable manner on the jet regulator 2 and the attachment screen 3 is retained in a releasable manner on the throughflow-quantity regulator 4.

The regulating profiling 7, which has grooves or recesses 9 oriented in the throughflow direction and distributed over the circumference, is arranged on the inner and/or outer circumferential wall of a regulating body 11, which in this case is designed in the form of a central regulating core 11 provided in the interior of the regulator housing 5. The regulating core 11 is connected to a holder 13, in this case configured in the form of a retaining ring, via at least one connecting crosspiece 12, which is oriented transversely to the throughflow direction. The at least one connecting crosspiece 12 is provided as a holding-down means for the flow-restricting body 6, which is located between the at least one connecting crosspiece 12 and the jet regulator 2, and it secures the flow-restricting body 6 in this region. The holder 13, which in this case is configured in the form of a retaining ring, can have its inflow-side end periphery region 14 fastened in a releasable manner on the attachment screen 13 and its outflow-side end periphery region 15 fastened in a releasable manner on the inner circumference of the regulator housing 5.

In the case of the insert unit 1 illustrated here, the regulating profiling 7 is provided on the circumferential wall of a central regulating core 11. This regulating core 11 is connected to the holder 13 via the at least one connecting crosspiece 12, and said holder can have its inflow-side end region 14 fastened in a releasable manner on the attachment screen 3 and its outflow-side end periphery region 15 fastened in a releasable manner on the inner circumference of the regulator housing 5. The connecting crosspiece 12 here, which connects the at least one holder 13 to the regulating core 11, is designed in the form of a holding-down part, which retains the flow-restricting body 6 in the region between the jet regulator 2, on the one hand, and the at least one connecting crosspiece 12, on the other hand. Since the holder 13 connects the attachment screen 3 to the throughflow-quantity regulator 4, the holder 13, which is connected to the regulating core 11, constitutes a kind of tamperproof seal, such that the attachment screen 3 and the jet regulator 2 are held together only when the throughflow-quantity regulator 4 is also installed. If for example the throughflow-quantity regulator 4 and/or the regulating core 11 are/is accidentally forgotten when the insert unit 1 is being assembled, then it is not possible for the attachment screen 3 to be installed either and the installation mistake is immediately evident.

The regulator housing 5 of the throughflow-quantity regulator 4 can have its outflow-side end region inserted in an insertion opening 16 on the jet regulator 2. The jet regulator 2 here has an annular shoulder 17, which delimits the insertion path of the regulator housing 5 into the insertion opening 16. The outer circumference of the regulator housing 5 has provided on it an annular flange 18, by which the regulator housing 5 can be inserted into the insertion opening 16. In the use position, the regulator housing 5 rests on the annular shoulder 17 by way of the annular flange 18.

The inner circumference of the regulator housing 5 has provided on it an annular flange 19, which is located approximately in a single plane with the annular flange 18. The annular flow-restricting body 6 rests on the annular flange 19 in the use position.

The holder 13 can be latched in a releasable manner on the attachment screen 3 and on the regulator housing 5. For this purpose, the holder 13, which is configured in the form of a retaining ring, has encircling latching protrusions 20, 21, which engage in corresponding latching recesses on the attachment screen 3 and on the regulator housing 5.

The jet regulator 2 here is configured in the form of an aerated jet regulator, in the case of which ambient air is mixed into the water flowing through. The jet regulator 2 has a sleeve-like jet-regulator housing 24, which has two housing parts 25, 26 which can be latched to one another in a releasable manner. A flow straightener 27, configured in this case in the form of a perforated plate with in particular honeycomb-form throughflow openings, is formed in one piece here on the downstream-side housing part 26. A jet divider 28 is arranged upstream of the flow straightener 27, as seen in the flow direction. The jet divider 28 here is of cup-like configuration and, on the circumferential wall of this cup shape, has a plurality of preferably uniformly spaced-apart throughflow openings 29, by which the water flowing through is divided up into a plurality of individual jets. The cup-like jet divider 28 has an angled circumferential periphery, by which the jet divider 28 rests on an annular shoulder on the inner circumference of the housing part 25. That end surface of the angled periphery region which is oriented transversely to the flow direction forms the annular shoulder 17 of the jet regulator 2 here.

The attachment screen 3 is of conical configuration here and has the tip of said cone shape oriented counter to the flow direction. The attachment screen 3 here has approximately honeycomb-form screen openings 30.

The invention claimed is:

1. A sanitary insert unit (1), comprising:

a jet regulator (2), an attachment screen (3) arranged upstream of the jet regulator (2) on an inflow side, a throughflow-quantity regulator (4) provided between the jet regulator (2) and the attachment screen (3), the throughflow-quantity regulator (4) includes a regulator housing (5), a flow-restricting body (6) which is made of elastic material, and a regulating body (11) having a regulating profiling (9) provided on at least one circumferential wall thereof, said flow-restricting body (6) and said regulating profiling (7) enclosing a control gap (8) therebetween which changes under a pressure of water flowing therethrough, the throughflow-quantity regulator (4) is retained in a releasable manner on the jet regulator (2) and the attachment screen (3) is retained in a releasable manner on the throughflow-quantity regulator (4), a holder (13) connected to the regulating body (11) via at least one connecting crosspiece (12), the at least one connecting crosspiece (12) is provided as a holding-down part for the flow-restricting body (6), which is arranged between the at least one connecting crosspiece (12) and the jet regulator (2), and the holder (13) has an inflow-side end periphery region (14) thereof fastened in a releasable manner on the attachment screen (3) and an outflow-side end periphery region (15) thereof fastened in a releasable manner on an inner circumference of the regulator housing (5).

2. The insert unit according to claim 1, wherein the throughflow-quantity regulator (4) includes the regulator housing (5), which has an outflow-side end region thereof inserted into an insertion opening (16) on the jet regulator (2).

3. The insert unit according to claim 2, wherein the jet regulator (2) has an annular shoulder (17), which delimits an insertion path of the regulator housing (5) into the insertion opening (16).

4. The insert unit according to claim 2, further comprising an annular flange (18) on an outer circumference of the regulator housing (5) by which the regulator housing (5) is insertable into the insertion opening (16).

5. The insert unit according to claim 1, further comprising an annular flange (19) on the inner circumference of the regulator housing (5) on which the flow-restricting body (6) rests in a use position.

6. The insert unit according to claim 1, wherein the holder (13) is latched in a releasable manner on at least one of the attachment screen (3) or the regulator housing (5).

7. The insert unit according to claim 1, wherein the holder (13) is configured as a retaining ring.

8. The insert unit according to claim 1, further comprising at least one latching protrusion (20, 21) on the holder (13) that interacts with a mating latching part on the attachment screen (3).

9. The insert unit according to claim 1, further comprising at least one latching protrusion (20, 21) on the holder (13) that interacts with a mating latching part on the regulator housing (5).

10. The insert unit according to claim 1, further comprising an upper latching protrusion (20) that interacts with a mating latching part on the attachment screen (3) and a lower latching protrusion (21) that interacts with a mating latching part on the regulator housing (5).

11. The insert unit according to claim 1, wherein the jet regulator (2) has a jet divider (28), which has a cup-shaped configuration and, on a circumferential wall thereof, has a plurality of spaced-apart through-flow openings (29), by which the water flowing therethrough is divided up into a plurality of individual jets.

12. The insert unit according to claim 11, wherein the through-flow openings (29) are spaced apart uniformly.

* * * * *